US006734630B1

(12) United States Patent
Choi et al.

(10) Patent No.: US 6,734,630 B1
(45) Date of Patent: May 11, 2004

(54) METAL HALOGEN ELECTRODELESS ILLUMINATION LAMP

(75) Inventors: Joon-Sik Choi, Seoul (KR); Hyung-Joo Kang, Kwangmyung (KR); Hyo-Sik Jeon, Kwangmyung (KR); Yong-Seog Jeon, Seoul (KR); Han-Seok Kim, Seoul (KR); Yuri Brodsky, ap. #151, Usilova str. 2, N-Novgorod, 603093 (RU); Vladimir Vdovin, Saransk (RU); Sergei Golubev, N-Novgorod (RU); Nikolai Kovalev, N-Novgorod (RU); Yuri Kalyazin, Saransk (RU); Yuri Korotchkov, Saransk (RU); Andrei Perminov, N-Novgorod (RU)

(73) Assignees: LG Electronics Inc., Seoul (KR); Yuri Brodsky, N-Novgorod (RU)

( * ) Notice: Subject to any disclaimer, the term of this patent is extended or adjusted under 35 U.S.C. 154(b) by 170 days.

(21) Appl. No.: 09/715,261

(22) Filed: Nov. 20, 2000

(30) Foreign Application Priority Data

Jan. 19, 2000 (KR) ..... 2000-2391

(51) Int. Cl.[7] ..... H01J 17/20

(52) U.S. Cl. ..... 313/638; 313/567; 313/643; 315/344

(58) Field of Search ..... 313/568, 570, 313/572, 160, 161, 567, 637, 638, 643; 315/344, 248

(56) References Cited

U.S. PATENT DOCUMENTS

| | | | | |
|---|---|---|---|---|
| 3,867,665 A | * | 2/1975 | Furmidge et al. | 313/485 |
| 3,989,972 A | | 11/1976 | Larson | |
| 4,027,190 A | | 5/1977 | Shintani et al. | |
| 4,591,759 A | | 5/1986 | Chalek et al. | |
| 5,117,312 A | | 5/1992 | Dolan | 359/858 |
| 5,363,015 A | | 11/1994 | Dakin et al. | 313/638 |
| 5,682,080 A | | 10/1997 | Dolan et al. | 313/570 |
| 5,834,895 A | * | 11/1998 | Dolan et al. | 313/570 |
| 6,313,587 B1 | | 11/2001 | MacLennan et al. | 315/248 |
| 6,469,444 B1 | * | 10/2002 | Leng et al. | 313/637 |
| 6,633,111 B1 | | 10/2003 | Kim et al. | 313/161 |

FOREIGN PATENT DOCUMENTS

| | | |
|---|---|---|
| GB | 2237927 | 5/1991 |
| JP | 57000838 | 5/1982 |
| JP | 0762476 | 3/1997 |
| JP | 10021885 | 1/1998 |
| JP | 0897191 | 2/1999 |

* cited by examiner

*Primary Examiner*—Edward J. Glick
*Assistant Examiner*—Elizabeth Gemmell
(74) *Attorney, Agent, or Firm*—Birch, Stewart, Kolasch & Birch, LLP

(57) ABSTRACT

A metal halogen electrodeless illumination lamp including a microwave generator coupled via a coupling means with a microwave cavity which contains a discharge bulb, and a microwave screen its function being performed by some part of the microwave cavity walls, which is transparent to optical radiation The discharge bulb contains a fill mixture of metal halogens, such as Bi halide, a mixture of Sn and Al and a mixture of their compounds, which emits visible optical radiation featuring a molecular spectrum.

23 Claims, 4 Drawing Sheets

METAL HALOGEN ELECTRODELESS ILLUMINATION LAMP

BACKGROUND OF THE INVENTION

1. Field of the Invention

The present invention relates to a metal halogen electrodeless illumination lamp, and particularly, to a gas discharging lamp in use for illumination instruments especially, to lamps containing a fill substance which, once excited with a discharge, emits optical radiation in the visible part of the spectrum, and more precisely to gas discharge illuminating lamps in which a metal halogen or a mixture of metal halogens is the primary component of the fill substance, and which can be used in various illumination applications such as illumination of streets and large premises 2. Description of the Background Art Metal halogen illumination lamps have been well known since the mid-1960's and have found extensive application owing to the high intensity of generated radiation. A metal halogen illumination lamp generally comprises a quartz tube filled with a mixture of substances capable of sustaining an arc discharge, and a glass envelope enclosing said quartz tube.

The quartz tube contains two electrodes between which an arc discharge is started when the lamp is operated. The primary component in the quartz tube fill is mercury. Additionally, a fill substance includes an inert gas which aids in starting a discharge, and one or a mixture of metal halogens, mostly iodides (refer to U.S. Pat. No. 3,234,421). The desired spectral output is provided by using halides of various metals and their compounds. For example, BiI3 (U.S. Pat. No. 3,989,972) compounds of Sn (U.S. Pat. No. 4,001,626), halides of sodium lithium and scandium (U.S. Pat. No. 4,247,798), Ti halide (U.S. Pat. No. 4,866,342), or Na and Ti iodides in a certain proportion (U.S. Pat. No. 5,225,738).

The major drawback of metal halogen lamps of this type is that they use mercury as the quartz tube fill substance, which generally amounts to tens of milligrams.

The hazards involved in manufacturing and utilization of mercury containing lamps have been recognized in that mercury is a highly toxic substance. Besides, there is a considerable loss of heat in these lamps to electrodes contained inside a quartz tube, and the electrodes material vaporizes, darkening the quartz tube, which limits the performance potential of the lamp.

Further research into ways to ensure a desired performance characteristics of mercury containing metal halogen illumination lamps has led to development of gas discharge electrodeless illumination lamps. These consist of an electromagnetic radiation source, for example, a microwave generator coupled via a coupling means with a microwave cavity containing a discharge bulb. The discharge bulb contains a fill substance (or a mixture of substances) which, when excited with a microwave discharge occurring therein, emits optical radiation that features a molecular spectrum. A certain part of the microwave cavity walls serves as a microwave screen which generally is a metal mesh constructed so that it is opaque to microwave energy, while being practically transparent to optical radiation.

This type lamps is known as gas discharge electrodeless illumination lamps as disclosed in U.S. Pat. No. 5,404,076, U.S. Pat. No. 5,661,365, U.S. Pat. No. 5,798,611 U.S. Pat. No. 5,834,895, U.S. Pat. No. 5,866,980. As the primary components in the discharge bulb fill substance these lamps use sulphur, selenium, tellurium or compounds thereof. Additionally, metals and or/or metal halogens are added in small portions to the main fill substance to vary certain spectral characteristics of the omitted optical radiation. Although this type of lamps do not need to contain mercury for operation, the latter element is nevertheless added in some cases, sometimes even in large quantities, to aid in starting a discharge and to upgrade the lamp performance characteristics.

These lamps do not have the drawbacks inherent in the mercury containing electrode lamps. Their merit, as opposed to electrodes-based illumination lamps, is long service life, absence of heat loss since, there are no electrodes, a fairly smooth spectrum, and a relatively high power of radiation.

The closest analog of both the first and the second variants of the developed metal halogen electrodeless illumination lamp in terms of basic design similarities is a metal halogen electrodeless illumination lamp as disclosed in U.S. Pat. No. 5,864,210. Like the above described electrodeless gas discharge lamps, the nearest analog comprises a microwave generator coupled via a coupling means with a microwave cavity containing a discharge bulb. The discharge bulb fill comprises either one metal halogen from the group of indium, gallium and thallium halides, or a mixture of these compounds, the metal halogen containing either one element from the group of iodine, bromine and chlorine, or a mixture of these substances. By the action of a high frequency discharge initiated in the discharge bulb fill substance, the latter emits optical radiation having a molecular spectrum.

The discharge bulb also contains a small amount of an inert gas to aid in starting a discharge. Some part of the microwave cavity serves as a microwave screen which is constructed as a metal mesh that is opaque to microwave radiation while being practically transparent to optical radiation. To upgrade the luminous efficiency of the lamp, zinc is added to the discharge bulb fill, which increases the internal pressure in the bulb.

However, the above described lamps contains mercury, the toxic substance. Also, since there is a considerable loss of heat in these lamps to electrodes contained inside a quart tube, the lamp efficiency is degraded. In addition, vaporization of the electrodes darkens the quartz tube, resulting in that its brightness is weakened as time passes.

SUMMARY OF THE INVENTION

Therefore, an object of the present invention is to provide an improved metal halogen electrodeless illumination lamp that emits optical radiation having a molecular spectrum, and directed to develop a metal halogen electrodeless illumination lamp having enhanced performance characteristics compared to that of the conventional one.

To achieve these and other advantages and in accordance with the purposed of the present invention, as embodied and broadly described herein, there is provided a metal halogen electrodeless illumination lamp including a microwave generator coupled via a coupling means with a microwave cavity containing a discharge bulb and a microwave screen its function being performed by some part of the microwave cavity walls, the part being transparent to optical radiation. The discharge bulb includes a mixture of metal halogens which emits visible optical radiation characterized by a molecular spectrum, immediately when excited with a high frequency discharge occurring therein.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Generally, an atomic spectrum is a line spectrum, but in the contrary, the molecular spectrum is a continuous spectrum such as the natural light, lessening a visual burden. Mercury or iron generates the atomic spectrum, while sulphur or selenium generates the molecular spectrum.

The metal halogen electrodeless illumination lamp of the present invention is featured in that the mixture of metal halogens contains halides of Sn and Al. In a particular embodiment of the present invention, the mixture of metal halogens contains $SnBr_2$ and $AlI_3$. In a different embodiment of the present invention, the mixture of metal halogens contains $SnI_2$ and $AlBr_3$.

Also, the mixture of metal halogens additionally contains bismuth (Bi) halide. In a specific embodiment, the Bi halide is $BiI_3$.

In the present invention, the halides contains either one element of chlorine, bromine and iodine. The discharge bulb may contain an inert gas.

In accordance with a variant of the metal halogen electrodeless illumination lamp of the present invention, the metal halogen electrodeless illumination lamp includes a microwave generator coupled via a coupling means with a microwave cavity containing a discharge bulb, and a microwave screen its function being performed by some part of the microwave cavity walls the part being transparent to optical radiation, of which the discharge bulb includes a mixture of metal halogens which emits visible optical radiation characterized by a molecular spectrum immediately when excited with a high frequency discharge occurring therein, and Bi halide is used as the metal halogens.

The discharge bulb fill substance may additionally include mixture of halogens containing compounds of tin (Sn) and aluminum (Al). In a particular embodiment, the mixture of metal halogens contains $SnI_2$ and $AlBr_3$.

In the above variants of the present invention, utilization of Bi halide, a mixture of Sn, Al halides, and also a mixture of compounds thereof for a discharge bulb fill substance ensures emission of visible optical radiation characterized by a molecular spectrum.

The embodiments of the present invention will now be described with reference to the accompanying drawings.

Figure 1:
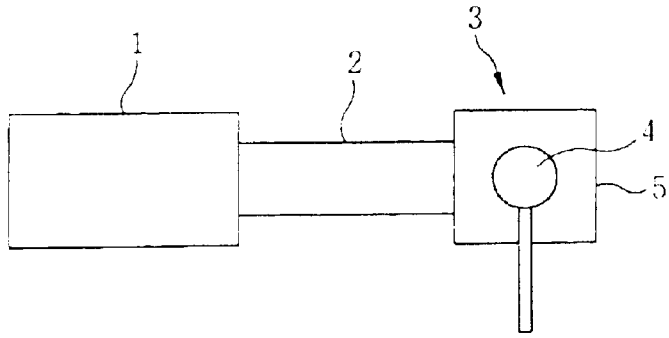
FIG. 1 shows a design variant of a metal halogen electrodeless illumination lamp of the present.

FIG. 1 is a schematic view of a metal halogen electrodeless illumination lamp, which includes a microwave generator 1 and a microwave screen 5. The microwave generator includes a microwave generator 1 coupled via a coupling means with a microwave cavity. The microwave cavity 3 includes a discharge bulb 4 filled with a substance which emits visible optical radiation characterized by a molecular spectrum, immediately when excited with a high frequency discharge occurring therein. The discharge bulb 4 also includes an inert gas. The function of the microwave screen 5 is performed by some part of the microwave cavity walls the part being transparent to optical radiation. For this effect, the part of the microwave cavity walls should include a hole or be formed of a metal mesh. In order to prevent some part of the lamp from overheating, the discharge bulb may be mounted to be rotated along with its axis.

For microwave generator 1, it is possible to use a standard magnetron. The output power for microwave generator 1 is determined by the requirement to produce a desired pressure of halides vapors in discharge bulb 4, and amounts to about 800 W.

The discharge bulb 4 may be made of a transparent quartz glass. The size and form of the discharge bulb 4 should be determined by a specific application of the metal halogen electrodeless illumination lamp. In a particular implementation of the present invention, the internal diameter of the discharge bulb 4 was 2.6 cm.

As a bulb fill substance providing emission of visible optical radiation having a molecular spectrum, it is possible to use a mixture of Sn and Al halides, or a Bi halide, or a mixture of thereof. The amount of a fill substance has to be such that it would allow to maintain the gas vapors pressure in the range of 1~20 atm at working temperature of the lamp.

The halides utilized in the electrodeless illumination lamp of the present invention may include iodine, bromine or chlorine. As the inert gas, argon or xenon may be used.

The discharge bulb 4 may additionally contain small amount of metals such as Zn, Na, Li or their compounds, to provide a desired spectral shift.

In a particular embodiment of the present invention, the microwave cavity 3 is a microwave resonator tuned to the working frequency of the microwave generator 1.

The metal halogen electrodeless illumination lamp of the present invention is operated as follows.

The microwave generator 1 generates microwave energy which is fed by the coupling means 2 to microwave cavity 3 in which an electromagnetic field is formed in result. When the electric field amplitude in microwave cavity 3 exceeds the breakdown value nigh frequency discharge is started in the discharge bulb 4 which excites the bulb fill to a plasma state. A mixture of Sn and Al halides as well as a Bi halide and a mixture of compounds thereof are substances which can emit visible optical radiation under a high frequency discharge. Part of the microwave power is absorbed by plasma and then emitted in the visible optical range of wavelengths. The microwave screen 5 transmits the optical radiation and is opaque to microwave energy.

An advantage of the metal halogen electrodeless illumination lamp of the present invention is that a molecular spectrum of radiation is ensured here without using mercury and only through utilization of a mixture of Sn and Al halides, or a Bi halide, or a mixture thereof as the discharge bulb 4 fill substance. However, in some cases, a small amount of mercury should be added to aid in starting a discharge.

First Embodiment

As the metal halides filled for the bulb, $SnBr_2$ and $AlI_3$ were used. The fill substance is as follows $SnBr_2$—0.3 mg/cm, $AlI_3$—1.2 mg/cm, Hg—1.0 mg/cm, Ar—10 torr.

In this particular embodiment, the parameters of the lamp were as follows:

Chromaticity: x=0.37; y=0.37

Color temperature: T=4200 K

Color rendering index (CRI): Ra=97

Figure 2:
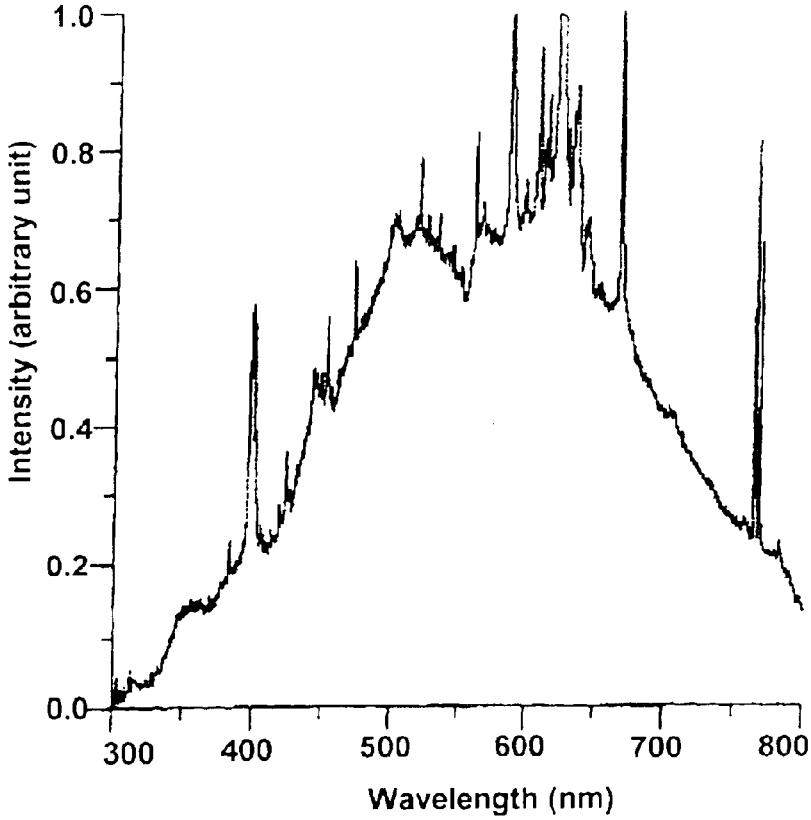
FIG. 2 is a spectral plot for a metal halogen electrodeless illumination lamp, in which the mixture of metal halogens contained in the discharge bulb includes $SnBr_2$ and $AlI_3$ in accordance with the first embodiment of the present invention.

A spectral plot for the metal halogen electrodeless illumination lamp of the present invention Is as shown in FIG. 2, which shows a smooth molecular spectrum for the mixture of SnBr2 and AlI3 with the lines of mercury atoms.

Second Embodiment

As the metal halides to be filled for the bulb, $SnI_2$ and $AlBr_3$ were used. The fill substance is as follows: $SnI_2$—0.4 mg/cm, $Albr_3$—0.8 mg/cm, Hg—1.0 mg/cm, Ar—15 torr.

In this particular implementation of the present invention, the lamp parameters were as follows.

Chromaticity: x=0.36; y=0.37

Color temperature: T=4700 K

CRI: Ra=91

Figure 3:
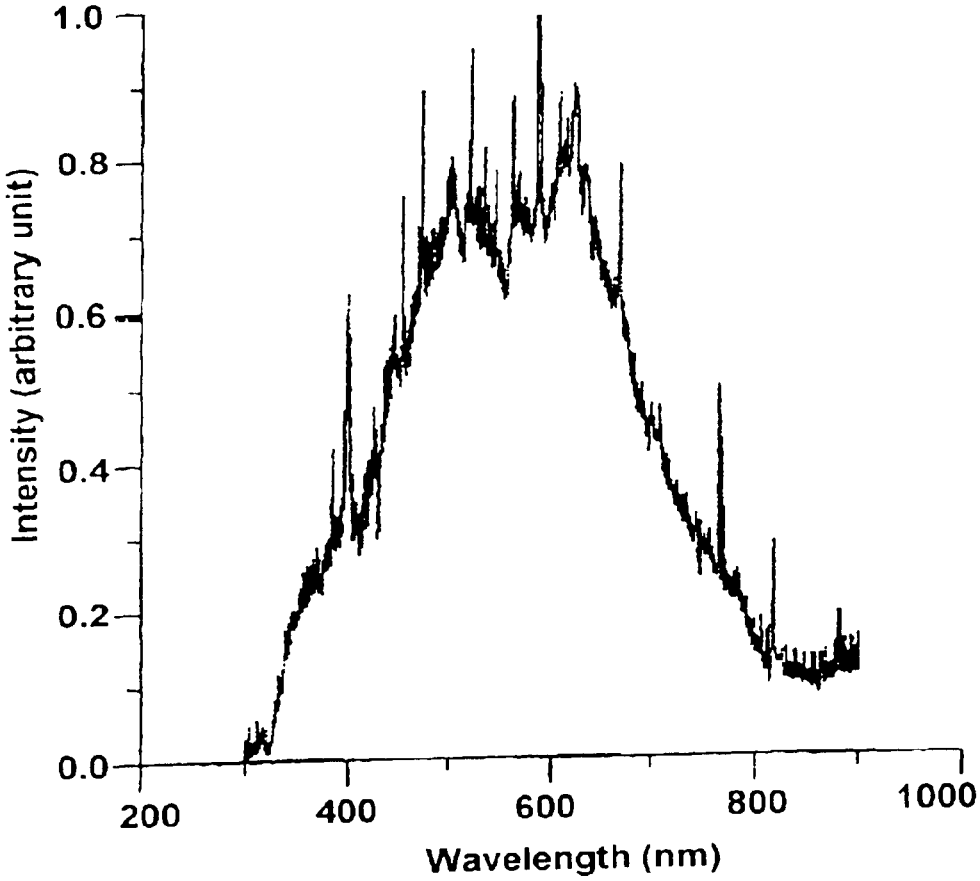
FIG. 3 is a spectral plot for a metal halogen electrodeless illumination lamp, in which the mixture of metal halogens contained in the discharge bulb includes $SnI_2$ and $AlBr_3$ in accordance with the first embodiment of the present invention.

A spectral plot for the electrodeless illumination lamp of the present invention is as shown in FIG. 3, which shows a smooth molecular spectrum for the mixture of $SnI_2$ and $AlBr_3$ with the lines of mercury atoms.

Third Embodiment

As the metal halides filled for the bulb, $SnI_2$ $AlBr_3$ and $BiI_3$ were used. The fill substance is as follows: $SnBr_2$—0.4 mg/cm, $AlI_3$—1.0 mg/cm, $BiI_3$—0.7 mg/cm, Hg—1.0 mg/cm, Ar—15 torr.

In this particular embodiment of the present invention, the parameters of the lamp were as follows:

Chromaticity: x=0.35; y=0.37

Color temperature: T=4900 K

CRI: Ra=90

Figure 4:
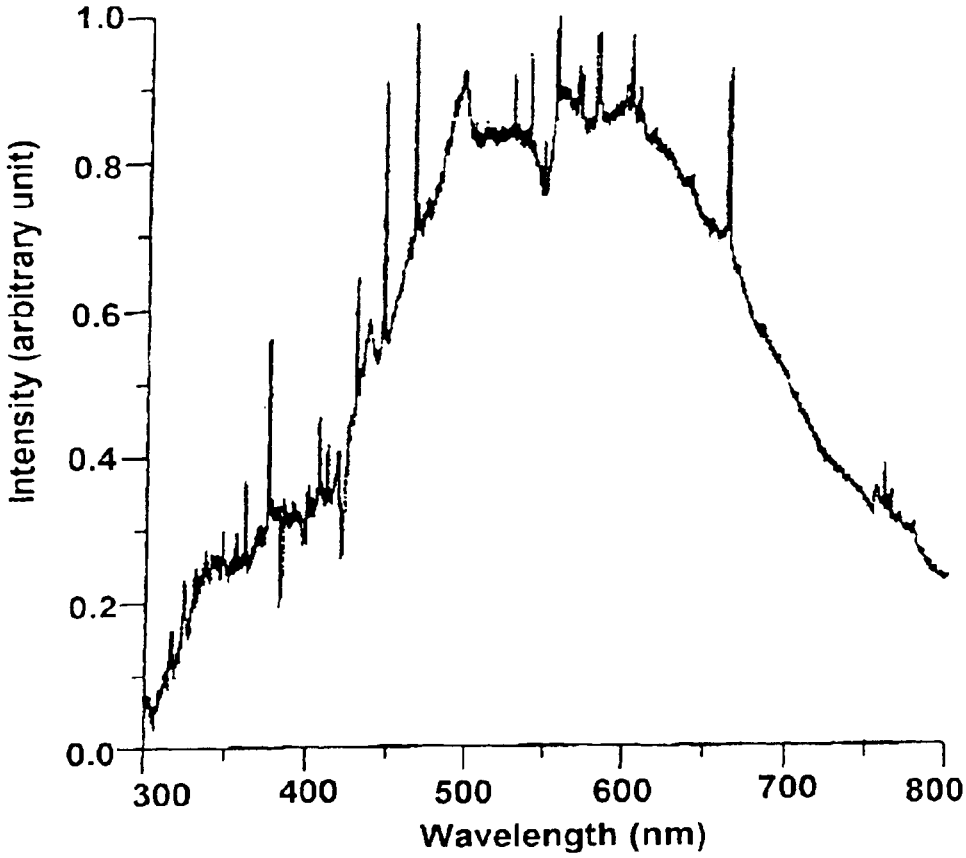
FIG. 4 is a spectral plot for a metal halogen electrodeless illumination lamp, in which the mixture of metal halogens contained in the discharge bulb includes $SnI_2$, $AlBr_3$ and $BiI_3$ in accordance with the first embodiment of the present invention.

A spectral plot for the metal halogen electrodeless illumination lamp of the present invention is as shown in FIG. 4, which shows a smooth molecular spectrum for the mixture of $SnBr_2$ $AlI_3$ and $BiI_3$ with the lines of mercury atoms Fourth Embodiment As the metal halides filled for the bulb, $BiI_3$ was used. The fill substance is as follows $BiI_3$—0.7 mg/cm, Hg—0.5 mg/cm, Ar—10 torr.

In this particular embodiment of the present invention, the parameters of the lamp were as follows:

Chromaticity: x=0.27; y 0.28

Color temperature: T=10000 K

CRI: Ra=80

Figure 5:
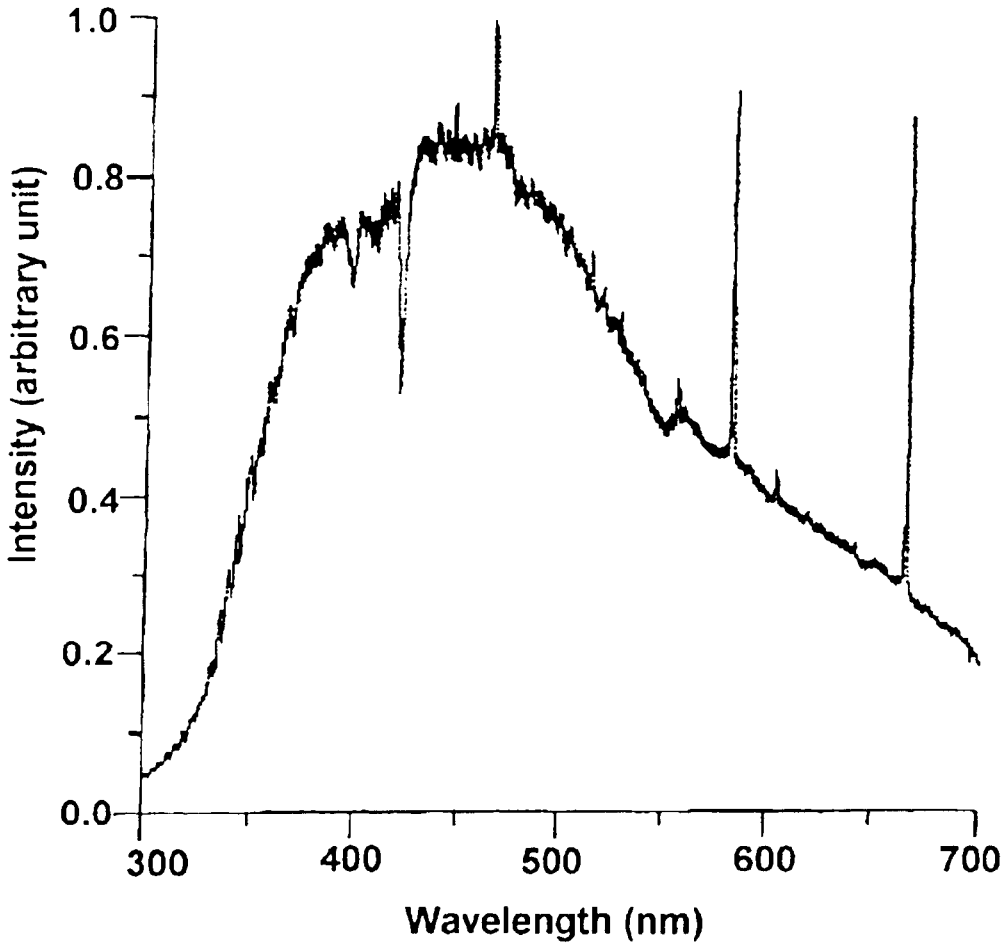
FIG. 5 is a spectral plot for a metal halogen electrodeless illumination lamp, in which the mixture of metal halogens contained in the discharge bulb includes $BiI_3$ in accordance with the first embodiment of the present invention.

A spectral plot for the metal halogen electrodeless illumination lamp of the present invention is as shown in FIG. 5, which shows that the continuous molecular spectrum for $BiI_3$ is slightly shifted toward the UV region, and also contains the lines of mercury atoms.

As so far described, the metal halogen electrodeless illumination lamp of the present invention has a durability longer than that of the conventional art, and there is no loss of heat to the electrodes. Also, very smooth spectrum is generated and a high power of radiation is ensured. In addition, a metal halogen electrodeless illumination lamp having an improved performance characteristics, compared to that of the conventional art, can be fabricated.

As the present invention may be embodied in several forms without departing from the spirit or essential characteristics thereof, it should also be understood that the above-described embodiments are not limited by any of the details of the foregoing description, unless otherwise specified but rather should be construed broadly within its spirit and scope as defined in the appended claims and therefore all changes and modifications that fall within the meets and bounds of the claims, or equivalence of such meets and bounds are therefore intended to be embraced by the appended claims.

What is claimed is:

1. A metal halogen electrodeless illumination lamp, comprising a microwave generator coupled via a coupling means with a microwave cavity which contains a discharge bulb, and a microwave screen, the function of which is performed by some part of walls of the microwave cavity, which is transparent to optical radiation, said discharge bulb containing a fill mixture with a main component of metal halogens which emits visible optical radiation featuring a molecular spectrum, immediately when excited with a high frequency discharge, and an inert gas, of which said main component of said fill mixture of metal halogens includes halides of Sn and Al.

2. The metal halogen electrodeless illumination lamp according to claim 1, wherein a halogen component of said halides is selected from the group consisting of chlorine, iodine and bromine.

3. The metal halogen electrodeless illumination lamp according to claim 1, wherein the fill mixture of metal halogens includes $SnBr_2$ and $AlI_3$.

4. The metal halogen electrodeless illumination lamp according to claim 1, wherein the fill mixture of metal halogens includes $SnI_2$ and $AlBr_3$.

5. The metal halogen electrodeless illumination lamp according to claim 1, wherein the fill mixture of metal halogens further includes bismuth halide.

6. The metal halogen electrodeless illumination lamp according to claim 5, wherein a halogen component of said halides is selected from the group consisting of chlorine, iodine and bromine.

7. The metal halogen electrodeless illumination lamp according to claim 5, wherein the fill mixture of metal halogens includes $SnI_2$ and $AlBr_3$.

8. The metal halogen electrodeless illumination lamp according to claim 5, wherein the fill mixture of metal halogens includes $SnBr_2$ and $AlI_3$.

9. The metal halogen electrodeless illumination lamp according to claim 5, wherein the fill mixture of metal halogens includes $BiI_3$.

10. The metal halogen electrodeless illumination lamp according to claim 1, wherein the amount of a fill substance is such that it would allow to maintain the gas vapors pressure in the range of 1~20 atm at working temperature of the lamp.

11. The metal halogen electrodeless illumination lamp according to claim 1, wherein the inert gas is argon or xenon.

12. The metal halogen electrodeless illumination lamp according to claim 1, wherein the discharge bulb additionally contains a small amount of at least one metal selected from the group consisting of Zn, Na, Li or a compound thereof.

13. A metal halogen electrodeless illumination lamp, comprising a microwave generator coupled via a coupling means with a microwave cavity which contains a discharge bulb, and a microwave screen, the function of which is performed by some part of walls of the microwave cavity, which is transparent to optical radiation, said discharge bulb containing a fill mixture with a main component of metal halogens which emits visible optical radiation featuring a molecular spectrum, immediately when excited with a high frequency discharge, and an inert gas, of which said main component of said fill mixture of metal halogens includes bismuth halide.

14. The metal halogen electrodeless illumination lamp according to claim 13, wherein a halogen component of said halides is selected from the group consisting of chlorine, iodine and bromine.

15. The metal halogen electrodeless illumination lamp according to claim 13, wherein the fill mixture of metal halogens includes $BiI_3$.

16. The metal halogen electrodeless illumination lamp according to claim 13, wherein the discharge bulb contains a mixture of halides additionally including compounds of Sn and Al.

17. The metal halogen electrodeless illumination lamp according to claim 16, wherein a halogen component of said halides is selected from the group consisting of chlorine, iodine and bromine.

18. The metal halogen electrodeless illumination lamp according to claim 16, wherein the fill mixture of metal halogens includes $BiI_3$.

19. The metal halogen electrodeless illumination lamp according to claim 16, wherein the fill mixture of metal halogens includes $SnBr_2$ and $AlI_3$.

20. The metal halogen electrodeless illumination lamp according to claim 16, wherein the fill mixture of metal halogens includes $SnI_2$ and $AlBr_3$.

21. The metal halogen electrodeless illumination lamp according to claim 13, wherein the amount of a fill substance is such that it would allow to maintain the gas vapors pressure in the range of 1~20 atm at working temperature of the lamp.

22. The metal halogen electrodeless illumination lamp according to claim 13, wherein the inert gas is argon or xenon.

23. The metal halogen electrodeless illumination lamp according to claim 13, wherein the discharge bulb additionally contains a small amount of at least one metal selected from the group consisting of Zn, Na, Li or a compound thereof.

* * * * *